US008143505B2

(12) United States Patent
Muramatsu

(10) Patent No.: US 8,143,505 B2
(45) Date of Patent: Mar. 27, 2012

(54) PEDAL APPARATUS OF ELECTRONIC MUSICAL INSTRUMENT

(75) Inventor: Shigeru Muramatsu, Shuchi-gun (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/685,512

(22) Filed: Jan. 11, 2010

(65) Prior Publication Data

US 2010/0175545 A1 Jul. 15, 2010

(30) Foreign Application Priority Data

Jan. 13, 2009 (JP) ..... 2009-004395

(51) Int. Cl.
*G10C 3/26* (2006.01)

(52) U.S. Cl. ..... 84/225; 84/227; 84/229; 84/353

(58) Field of Classification Search ..... None
See application file for complete search history.

(56) References Cited

U.S. PATENT DOCUMENTS 7,019,201 B2 * 3/2006 Meisel ..... 84/16
7,115,805 B1 * 10/2006 Vandervoort ..... 84/422.1
7,579,538 B2 * 8/2009 Franz ..... 84/402
7,893,334 B2 * 2/2011 Iwamoto et al. ..... 84/422.1
2001/0000569 A1 * 5/2001 Meisel ..... 84/688
2009/0229440 A1 * 9/2009 Iwamoto et al. ..... 84/229
2009/0235803 A1 * 9/2009 Iwamoto et al. ..... 84/229
2010/0236388 A1 * 9/2010 Komatsu ..... 84/626

FOREIGN PATENT DOCUMENTS

JP 2004-334008 A 11/2004

* cited by examiner

*Primary Examiner* — Marlon Fletcher
(74) *Attorney, Agent, or Firm* — Rossi, Kimms & McDowell LLP

(57) ABSTRACT

A lever 40 is supported by a lever supporting portion 41. Through a first pivoting member 52, the lever 40 is urged by a reaction force stabilization spring 54, a first spring 55 and a second spring 56. The downward displacement of a second pivoting member 53 is restricted by a fixed supporting member FR. If the urging force of the first spring 55 exceeds the urging force of the second spring 56, the second pivoting member 53 is displaced upward. A contact member which is in contact with the first pivoting member 52 and the second pivoting member 53 to produce friction force is also provided.

14 Claims, 12 Drawing Sheets

PEDAL APPARATUS OF ELECTRONIC MUSICAL INSTRUMENT

BACKGROUND OF THE INVENTION

1. Field of the Invention

The present invention relates to a pedal apparatus for use in an electronic musical instrument, the pedal apparatus controlling the manner in which a musical tone is generated.

2. Description of the Related Art

Conventionally, it is known that a pedal apparatus for use in an electronic musical instrument is designed to provide a player with a feeling similar to that perceived by a player on manipulation of a pedal of an acoustic piano. For example, Japanese Unexamined Patent Publication No. 2004-334008 discloses a pedal apparatus which has a lever that pivots in response to a depression of a pedal and a first spring and a second spring provided in parallel in order to urge the lever. The disclosed pedal apparatus is designed such that only the first spring urges the lever if the lever is shallowly depressed, whereas the first spring and the second spring urge the lever if the lever is depressed by a certain amount or more. Therefore, the disclosed pedal apparatus provides a player with a feeling as if the pedal became heavier at a certain point of a depression of the pedal. By such a structure, the disclosed pedal apparatus imitates the feeling perceived by the player when he manipulates a damper pedal of an acoustic piano.

SUMMARY OF THE INVENTION

As for an acoustic piano, if a player depresses a damper pedal, the player recognizes stepwise changes in the rate of change in the reaction force of the pedal according to the amount of displacement of the pedal. The stepwise change will be explained, referring to FIG. 12. FIG. 12 shows characteristics of the reaction force of a pedal lever of a damper pedal of an acoustic piano, the reaction force being exerted when the damper pedal is depressed, not when the damper pedal is released. The lever of the damper pedal of the acoustic piano is connected with dampers through some connecting portions. These connecting portions are provided with play (room or space). In a range of A0 of FIG. 12 where the damper pedal is depressed shallowly, therefore, the manipulation of the pedal will not be conveyed to the dampers, resulting in a small rate of change in the reaction force of the pedal. If the amount of displacement of the damper pedal increases to move into a range A1 of FIG. 12, the force of depression is conveyed to the dampers through the connecting portions, resulting in the increase in the rate of change in the reaction force of the pedal because of the increase in the reaction force caused by elastic constituents of the connecting portions and the weight and frictions of the dampers which start being partially lifted from strings. If the amount of displacement of the lever increases further to move into a range A2 of FIG. 12, the dampers fully leave the strings, resulting in no increase in the reaction force caused by the elastic constituents of the connecting portions. Therefore, the rate of change in the reaction force of the pedal reduces. A range (a range AH in the figure) which extends from a later point in the range A1 across the border between the ranges A1, A2 to enter the range A2 is commonly referred to as a half pedal range. In the range AH, skilled players subtly change the depth of the depression of the damper pedal to delicately vary the timbre, resonance and the like of musical tones to be generated. In addition, a shift pedal of an acoustic piano is designed such that a lever is connected with a string-striking mechanism through some connecting portions, resulting in stepwise changes in the reaction force as in the case of the damper pedal. Depending on models and manufacturers, furthermore, the respective structures of the pedals, the connecting portions, the dampers and the string-striking mechanism vary, and so do the respective widths of the ranges A1, AH and A2 of FIG. 12. In addition, there is no difference in the rate of change in the reaction force of the pedal between the ranges A0, A1 in some cases. However, the conventional pedal apparatus for use in an electronic musical instrument as described above fails to provide the player with the feeling that the player of an acoustic piano perceives at the range of A2 of FIG. 12 (the state where the rate of change in the reaction force reduces) which follows the range A1 of FIG. 12.

As for an acoustic piano, furthermore, when a player depresses a pedal, hysteresis occurs in characteristics of varying reaction forces against depression of the lever according to an amount of depression of the lever. The hysteresis will be described with reference to FIG. 13. The lever of the damper pedal is connected with the damper through a plurality of movable parts, cushion members, springs and axes. Due to viscosity and frictions of the entire pedal apparatus, therefore, hysteresis occurs in characteristics of varying reaction forces against depression of the lever according to an amount of depression of the lever as shown by solid lines in FIG. 13. More specifically, the player perceives the manipulation of the lever as lighter when he releases the pedal than when he depresses it. In addition, the lever of the shift pedal of an acoustic piano is connected with the string-striking mechanism of a keyboard through a plurality of movable parts, cushion members, springs and axes. Due to viscosity and frictions of the entire pedal apparatus, therefore, hysteresis occurs in characteristics of varying reaction forces against depression of the lever according to an amount of depression of the lever as shown by dashed lines in FIG. 13. The width of the hysteresis of the shift pedal (difference in the reaction force of the lever between a depression of the lever and a release of the lever) is wider than that of the damper pedal. Particularly, as shown in FIG. 13, the difference of the width is large when the amount of depression of the lever is in the range A2. However, the conventional pedal apparatus for use in an electronic musical instrument as described above is designed such that the lever is only urged by the springs, having a small number of movable parts that form the entire pedal apparatus. As a result, the viscosity and frictions of the entire conventional pedal apparatus are low, resulting in a narrow hysteresis in characteristics of varying reaction forces against depression of the lever according to an amount of depression of the lever. Consequently, the conventional pedal apparatus fails to make the player perceive any difference of reaction force against the manipulation of the pedal between depressing the pedal and releasing it, being short of reproducing the feeling that the player perceives when he manipulates pedals of an acoustic piano. Due to the narrow hysteresis of the conventional pedal apparatus, in addition, even insignificant variation in the force exerted by the player to depress the pedal results in variation in the amount of depression, making it difficult for the player to control the mode in which a musical tone is generated.

The present invention was accomplished to solve the above-described problems, and an object thereof is to provide a pedal apparatus for use in an electronic musical instrument, the pedal apparatus allowing a player to feel as if the player were manipulating pedals of an acoustic piano.

In order to achieve the above-described object, it is a feature of the present invention to provide a pedal apparatus for use in an electronic musical instrument, the pedal apparatus comprising a lever (40) which is supported by a fixed supporting member (FR) and pivots by a player's depression of the lever; a movable member (53) whose displacement from a first predetermined position toward a first direction is restricted by the fixed supporting member (FR) and which is displaced toward a second direction opposite to the first direction on a player's depression of the lever (40); a conveying member (45, 52) which is displaced by the pivoting of the lever (40) to convey the pivoting of the lever (40) to the movable member (53); a first spring (55) which is provided between the conveying member (45, 52) and the movable member (53) to urge the movable member (53) toward the second direction on the player's depression of the lever (40); a second spring (56) which is provided between the movable member (53) and the fixed supporting member (FR) to urge the movable member (53) toward the first direction; a first contact member (51*b*, 59) which is in contact with the conveying member (45, 52) to produce a first friction force in a direction which restrains the displacement of the conveying member (45, 52); and a second contact member (510 which is in contact with the movable member (53) to produce a second friction force in a direction which restrains the displacement of the movable member (53). In this case, the second friction force may be greater than the first friction force.

The present invention configured as described above can make the rate of change in the reaction force of the lever (40) vary from a greater rate of change to a smaller rate of change according to the amount of depression of the lever (40). In addition, the present invention allows to exhibit hysteresis in the reaction force of the lever (40). Therefore, the present invention can provide the player with feeling similar to that the player perceives when he manipulates pedals of an acoustic piano shown in FIG. 12 and FIG. 13.

More specifically, the displacement of the conveying member (45, 52) toward the first direction from a second predetermined position which is away from the first predetermined position toward the first direction may be restricted by the fixed supporting member (FR), while the conveying member may be displaced toward the second direction on the player's depression of the lever (40); and the second spring (56) may restrict the displacement of the movable member (53) toward the second direction if the amount of player's depression of the lever (40) is smaller than a predetermined amount, and may allow the displacement of the movable member (53) toward the second direction if the amount of player's depression of the lever (40) is greater than or equal to the predetermined amount. In this case, the first spring (55) may be designed such that the both ends of the first spring (55) are in contact with the conveying member (45, 52) and the movable member (53) in a state where the lever (40) is not depressed.

According to the specific invention configured as described above, if the amount of depression of the lever (40) is small, the movable member (53) stands still at the predetermined position until the force exerted by the lever (40) through the first spring (55) to urge the movable member (53) toward the second direction reaches a combined force formed of a spring force exerted by the second spring (56) to urge the movable member (53) toward the first direction, the weight of the movable member (53) and the static friction force of the movable member (53). In this state, therefore, the spring force exerted by the first spring (55) is exerted on the lever (40). Then, if the amount of depression of the lever (40) increases further, so that the force exerted by the lever (40) through the first spring (55) to urge the movable member (53) toward the second direction equals or exceeds the combined force formed of a spring force exerted by the second spring (56) to urge the movable member (53) toward the first direction, the weight of the movable member (53) and the static friction force of the movable member (53), the movable member (53) starts being displaced toward the second direction. The amount of depression of the lever (40) at the start of the displacement of the movable member (53) corresponds to the predetermined amount of depression.

Then, if the amount of depression of the lever (40) increases further from this state, the movable member (53) is displaced toward the second direction, with the second spring (56) starting acting. In this state, it is considered that the first spring (55) and the second spring (56) are connected serially, so that the spring constant of the serial springs is smaller than that of the first spring (55). In this state, therefore, the spring force exerted by the serial springs formed of the first spring (55) and the second spring (56) is applied to the lever (40). As a result, the present invention can make the rate of change in the reaction force of the lever (40) vary from a greater rate of change to a smaller rate of change according to the amount of depression of the lever (40).

In addition, the first and second contact members (51*b*, 59, 51*f*) which are in contact with the conveying member (45, 52) and the movable member (53) to produce friction force in the direction which restrains the pivoting of the conveying member and the movable member enables hysteresis in the reaction force of the lever (40). Therefore, the present invention can provide the player with feeling similar to that the player perceives when he manipulates pedals of an acoustic piano.

In a case where the player deeply depresses the lever (40) and then sharply decreases the amount of depression, and in a case where the player periodically changes the amount of depression of the lever (40), the movable member (53) can temporarily oscillate due to collaboration of the inertial force and spring force applied to the movable member (53). Furthermore, the movable member (53) can collide with the fixed supporting member (FR) to cause oscillation of the movable member (53). The oscillation of the movable member (53) is conveyed to the lever (40) through the first spring (55) to be perceived by the player as unnatural reaction force. As for the present invention configured as described above, however, the respective spring forces of the first spring (55) and the second spring (56) act on the movable member (53) in the directions opposite to each other. Therefore, the present invention is able to suppress or quickly cease the oscillation. Furthermore, the second contact member (51*f*) produces the friction force on the movable member (53) in the direction which suppresses or quickly ceases the oscillation. Therefore, the present invention can stabilize the reaction force of the lever (40).

In a case where the influence caused by the weight of the movable member (53) can be ignored, it can be considered that the inertial force acting on the movable member (53) can be also ignored. Therefore, the present invention can prevent the unnatural reaction force, also achieving reduction in weight of the pedal apparatus.

It is another feature of the present invention to provide a pedal apparatus for use in an electronic musical instrument, the pedal apparatus further comprising a third spring (54) which is provided between the fixed supporting member (FR) and the conveying member (45, 52) to exert a spring force on the lever (40) at all times in a direction which resists the depression of the lever (40). In this case, the first spring (55) may be designed such that the both ends of the first spring (55) are in contact with the conveying member (45, 52) and the movable member (53) in a state where the lever (40) is not depressed. The first spring (55) may also be designed such that one end of the first spring (55) is apart from the conveying member (45, 52) or the movable member (53) in a state where the lever (40) is not depressed.

According to the invention configured as described above, if the amount of depression of the lever (40) is small, the movable member (53) stands still at the predetermined position until the force exerted by the lever (40) through the first spring (55) to urge the movable member (53) toward the second direction reaches the combined force formed of a spring force exerted by the second spring (56) to urge the movable member (53) toward the first direction, the weight of the movable member (53) and the static friction force of the movable member (53). In this state, therefore, the spring force exerted by the first spring (55) and the spring force exerted by the third spring (54) are exerted on the lever (40) in parallel. Then, if the amount of depression of the lever (40) increases further, so that the force exerted by the lever (40) through the first spring (55) to urge the movable member (53) toward the second direction equals or exceeds the combined force formed of a spring force exerted by the second spring (56) to urge the movable member (53) toward the first direction, the weight of the movable member (53) and the static friction force of the movable member (53), the movable member (53) starts being displaced toward the second direction. The amount of depression of the lever (40) at the start of the displacement of the movable member (53) corresponds to the predetermined amount of depression.

Then, if the amount of depression of the lever (40) increases further from this state, the movable member (53) is displaced toward the second direction, with the second spring (56) starting acting. In this state, it is considered that the first spring (55) and the second spring (56) are connected serially, so that the spring constant of the serial springs is smaller than that of the first spring (55). In this state, therefore, the spring force exerted by the third spring (54) and the spring force exerted by the serial springs formed of the first spring (55) and the second spring (56) are applied to the lever (40) in parallel. As a result, the present invention can make the rate of change in the reaction force of the lever (40) vary from a greater rate of change to a smaller rate of change according to the amount of depression of the lever (40).

In the case where the first spring (55) is designed such that one end of the first spring (55) is apart from the conveying member (45, 52) or the movable member (53) in a state where the lever (40) is not depressed, the both ends of the first spring (55) are not in contact with the conveying member (45, 52) and the movable member (53) as long as the amount of depression of the lever (40) is small. Therefore, only the spring force exerted by the third spring (54) is applied to the lever (40). As a result, the rate of change in the reaction force of the lever (40) can increase and decrease stepwise according to the amount of depression of the lever (40) to start with a low rate of change to increase to a high rate to be followed by a medium rate, for example.

Similarly to the case where the pedal apparatus is not provided with the third spring (54), the movable member (53) can temporarily oscillate due to collaboration of the inertial force and spring force applied to the movable member (53). Furthermore, the movable member (53) can collide with the fixed supporting member (FR) to cause oscillation of the movable member (53). The oscillation of the movable member (53) is conveyed to the lever (40) through the first spring (55) to be perceived by the player as unnatural reaction force. As for the present invention configured as described above as well, however, the respective spring forces of the first spring (55) and the second spring (56) act on the movable member (53) in the directions opposite to each other. Therefore, the present invention is able to suppress or quickly cease the oscillation. Therefore, the present invention can stabilize the reaction force of the lever (40). Furthermore, because the force of the springs acting on the lever 40 can be divided into the spring force exerted by the third spring (54), and the spring force exerted by the first spring (55) and the second spring (56), the spring force (spring constant) exerted by the first spring (55) and the second spring (56) can be reduced. Therefore, the present invention is able to reduce the unnatural reaction force caused by the oscillation. As a result, the present invention can stabilize the reaction force of the lever (40).

In a case where the influence caused by the weight of the movable member (53) can be ignored, it can be considered that the inertial force acting on the movable member (53) can be also ignored. Therefore, the present invention can prevent the unnatural reaction force, also achieving reduction in weight of the pedal apparatus.

It is still another feature of the present invention to provide a pedal apparatus for use in an electronic musical instrument, the pedal apparatus further comprising an adjustment mechanism for adjusting magnitude of friction force to be produced on the movable member (53).

According to the invention configured as described above, as the damper pedal and the shift pedal of an acoustic piano, in spite of their different widths of hysteresis, the present invention can realize the characteristics of the reaction force of the respective pedals by adjusting the magnitude of the friction force to be produced on the movable member (53).

It is a further feature of the present invention to provide a pedal apparatus for use in an electronic musical instrument, the pedal apparatus further comprising a sensor for sensing amount of displacement of the lever (40).

According to the invention configured as described above, any friction force will not be produced on the lever (40) itself. Because the friction force acting as reaction force to be exerted on the lever (40) is divided into the conveying member (45, 52) and the movable member (53), in addition, the friction force to be produced on the conveying member (45, 52) can be reduced. If the depression of the lever (40) is released, therefore, the lever (40) returns to its initial position, so that the sensor (66) senses the recovery of the lever (40) to the initial position. On the release of the depression of the lever (40), therefore, by use of the sensed recovery of the lever (40) to the initial position sensed by the sensor (66), the pedal apparatus of the present invention reliably cancels the addition of the damper effect and the shift effect to musical tones to be generated.

DESCRIPTION OF THE PREFERRED EMBODIMENT a. General Configuration

Figure 1:
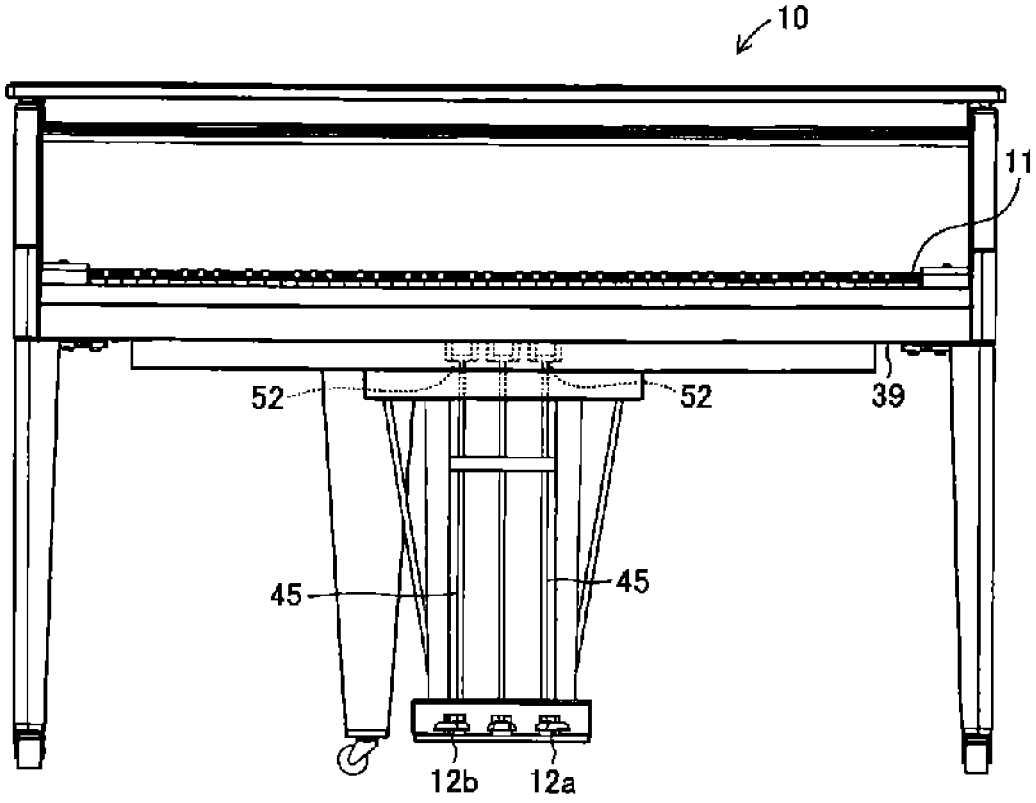
FIG. 1 is a front view indicating an electronic musical instrument to which a pedal apparatus according to a first and second embodiments of the present invention is applied.
Figure 2:
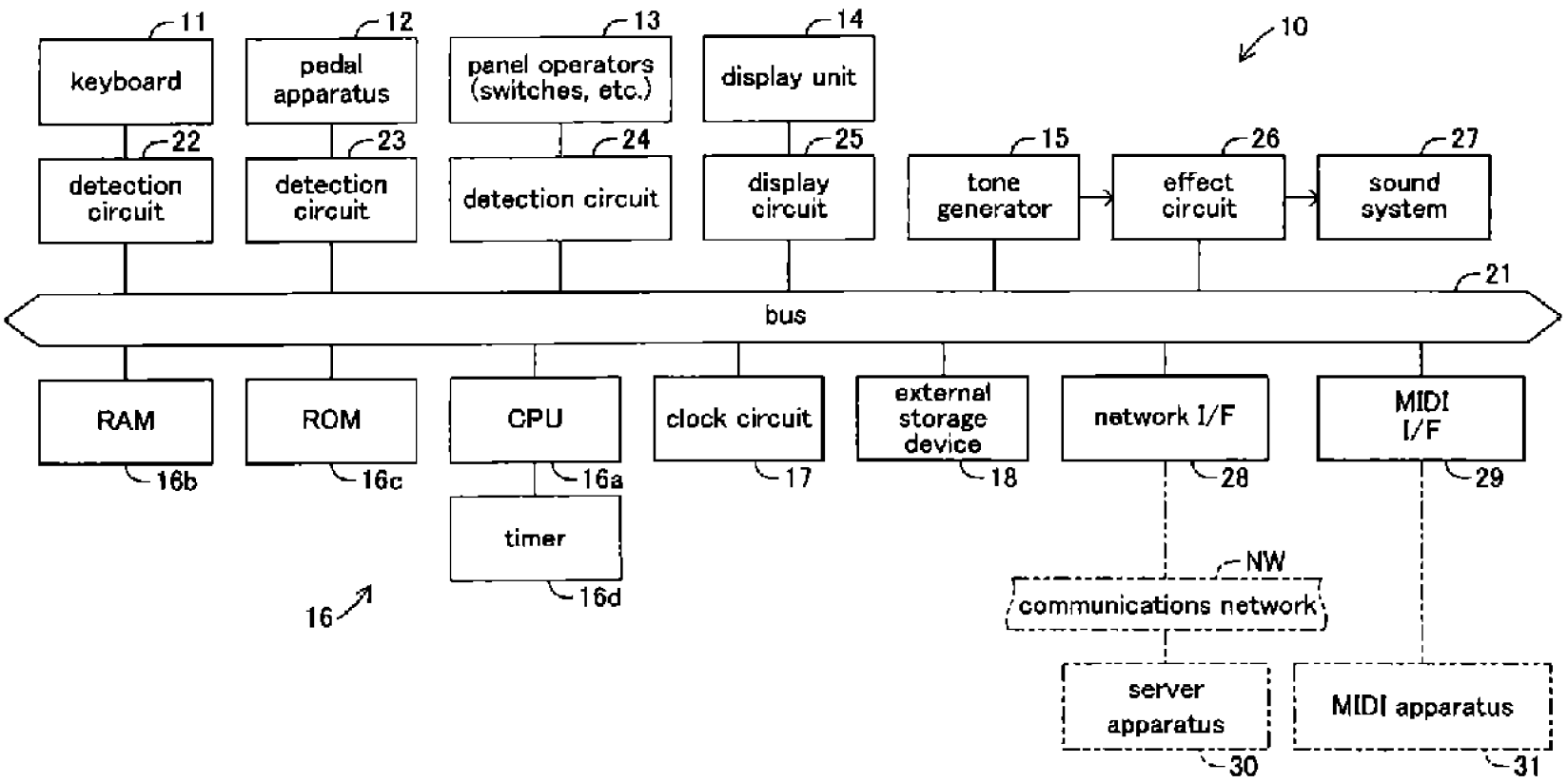
FIG. 2 is a block diagram indicating a general configuration of the electronic musical instrument indicated in FIG. 1.

Before detailed descriptions about a pedal apparatus according to an embodiment of the present invention, a general configuration of an electronic musical instrument to which the pedal apparatus according to the present invention is applied will be described. FIG. 1 is a front view showing the whole of an electronic musical instrument 10 to which the pedal apparatus according to the present invention is applied. FIG. 2 is a block diagram showing a configuration of the electronic musical instrument 10. The electronic musical instrument 10 has a keyboard 11, a pedal apparatus 12, a plurality of panel operators 13, a display unit 14, a tone generator 15, a computer portion 16, a clock circuit 17 and an external storage device 18.

The keyboard 11 is operated with player's hands to specify pitches of musical tones to be generated. Each operation of the keyboard 11 is detected by a detection circuit 22 connected to a bus 21 to supply data (e.g., note data, key-on data, key-off data) indicative of the operation to the computer portion 16 via the bus 21. The pedal apparatus 12 is operated with a player's foot to control the mode in which a musical tone is generated by the electronic musical instrument 10. In the embodiment of the present invention which will be described later, the pedal apparatus 12 is a damper pedal 12*a* for adding a damper effect to a musical tone to be generated by a depression of the pedal apparatus 12 with the player's foot or a shift pedal 12*b* for changing timbre and tone volume of a musical tone to be generated by a depression of the pedal apparatus 12. As described in detail later, each operation of the pedal apparatus 12 is detected by a detection circuit 23 connected to the bus 21 to supply data indicative of the operation to the computer portion 16 via the bus 21. The plurality of panel operators 13 are provided in order to allow the player to program operations of the electronic musical instrument. Each operation of the panel operators 13 is detected by a detection circuit 24 connected to the bus 21 to supply data indicative of the operation to the computer portion 16 via the bus 21. The display unit 14, which is formed of a liquid crystal display, CRT or the like, displays characters, numerals, graphics and the like on a screen. The display unit 14 is controlled by a display circuit 25 connected to the bus 21 to specify what to display on the basis of instruction signals and data on display supplied to the display circuit 25 via the bus 21.

The tone generator 15, which is connected to the bus 21, generates digital musical tone signals on the basis of musical tone control data (note data, key-on data, key-off data, tone color control data, loudness control data, etc.) supplied from the computer portion 16 via the bus 21 and supplies the generated digital musical tone signals to an effect circuit 26. The effect circuit 26, which is connected to the bus 21, adds effects to the supplied digital musical tone signals on the basis of effect control data supplied from the computer portion 16 via the bus 21 and supplies the digital musical signals to which the effects have been added to a sound system 27. The above-described damper effect and the shift effect are added to digital musical tone signals by the tone generator 15 or the effect circuit 26. The sound system 27, which is configured by a D/A converter, amplifiers, speakers and the like, converts the supplied digital musical tone signals to which the effects have been added to analog musical tone signals and emits musical tones corresponding to the analog musical tone signals.

The computer portion 16 is formed of a CPU 16*a*, a RAM 16*b* and a ROM 16*c* connected to the bus 21 as well as a timer 16*d* connected to the CPU 16*a*. The computer portion 16 executes programs to control the electronic musical instrument 10. The clock circuit 17 continuously measures date and time. The external storage device 18, which includes a hard disk and flash memory incorporated into the electronic musical instrument 10, various kinds of storage media such as a compact disk connectable to the electronic musical instrument 10 and drive units for the storage media, can store and read a large amount of data and programs.

The electronic musical instrument 10 further includes a network interface circuit 28 and a MIDI interface circuit 29. The network interface circuit 28 connects the electronic musical instrument 10 to a server apparatus 30 via a communications network NW so that the electronic musical instrument 10 can communicate with the server apparatus 30. The MIDI interface circuit 29 connects the electronic musical instrument 10 to an external MIDI apparatus 31 such as another electronic musical instrument or a sequencer so that the electronic musical instrument 10 can communicate with the external MIDI apparatus 31.

b. First Embodiment

Figure 3A:
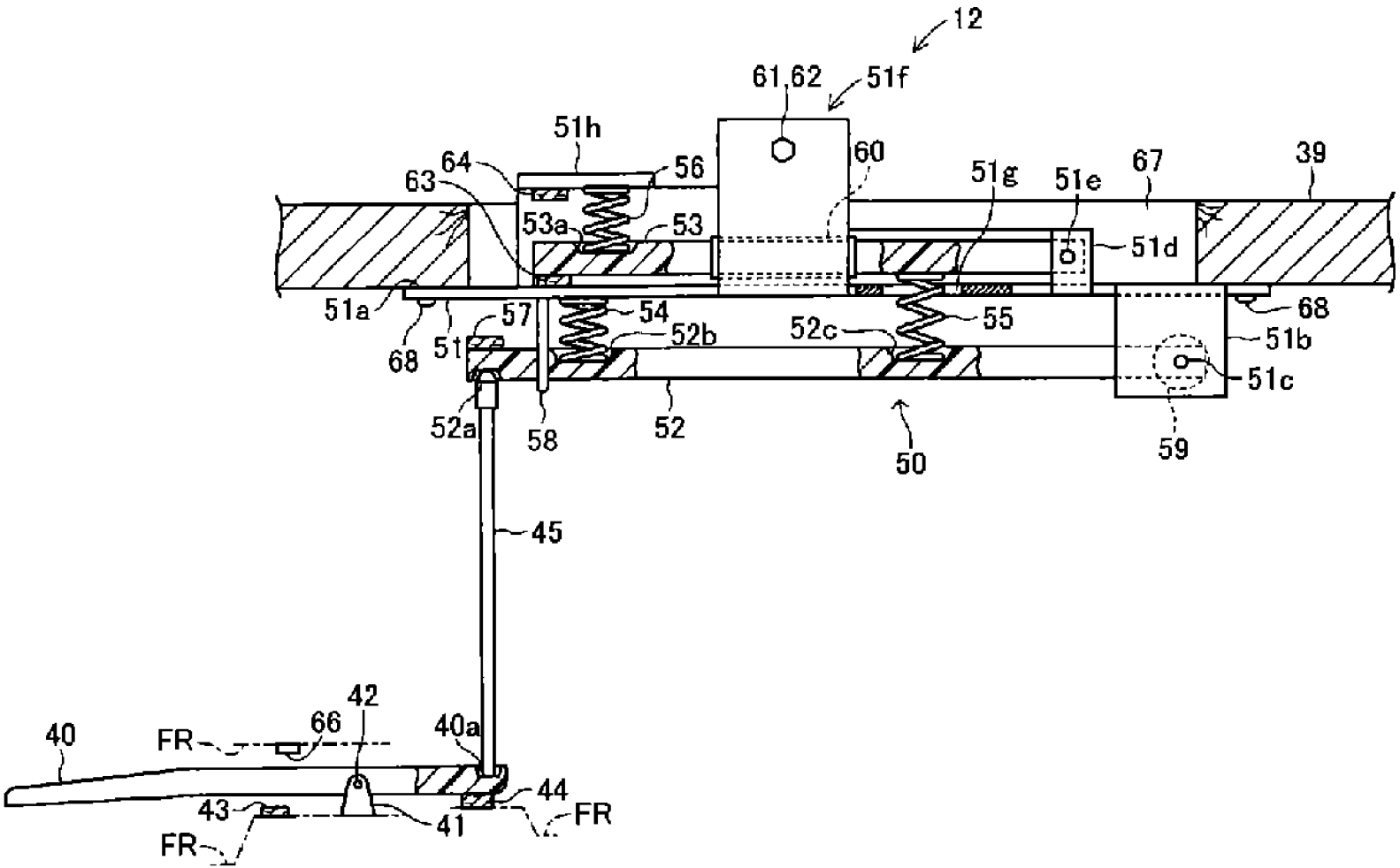
FIG. 3A is a side view of the pedal apparatus according to the first embodiment of the present invention.

Next, the first embodiment of the pedal apparatus 12 according to the present invention will be described in detail. FIG. 3A is the pedal apparatus 12 seen from the treble side. FIG. 3A indicates a state in which the pedal apparatus 12 is mounted on a shelf board 39 of the electronic musical instrument. A lever 40 is a long plate-shaped member. A forward part (the left side in FIG. 3A) of the lever 40 is a wide depression part on which a player steps. The lever 40 is supported at a middle part thereof by a lever supporting portion 41 provided on a frame FR so that the front end of the lever 40 can pivot upward and downward about a rotary shaft 42. Below the middle part of the lever 40, a long lower limit stopper 43 made of a shock-absorbing member such as rubber and felt extends in a lateral direction to be rigidly connected to the frame FR. The lower limit stopper 43 restricts downward displacement of the forward part of the lever 40. The frame FR is a structural body for supporting various parts of the pedal apparatus 12 and a housing itself of the pedal apparatus 12. Below a rear part of the lever 40, an upper limit stopper 44 which is similar to the lower limit stopper 43 is rigidly connected to the frame FR to restrict upward displacement of the forward part of the lever 40.

Behind the rotary shaft 42 of the lever 40, the lower end of a drive rod 45 is inserted into a concave portion 40*a* provided on the top surface of the rear part of the lever 40 so that the drive rod 45 is in contact with the bottom surface of the concave portion 40*a*. The drive rod 45, which is a long member, extends upward from the rear part of the lever 40. The drive rod 45 is allowed to move only upward and downward by a guide member which is not shown.

Figure 3B:
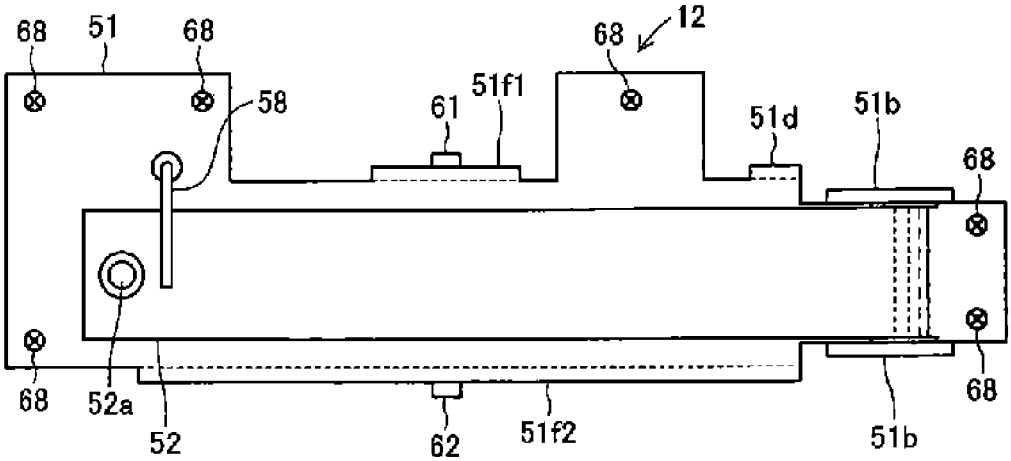
FIG. 3B is a bottom view of a reaction force generating mechanism indicated in FIG. 3A.
Figure 3C:
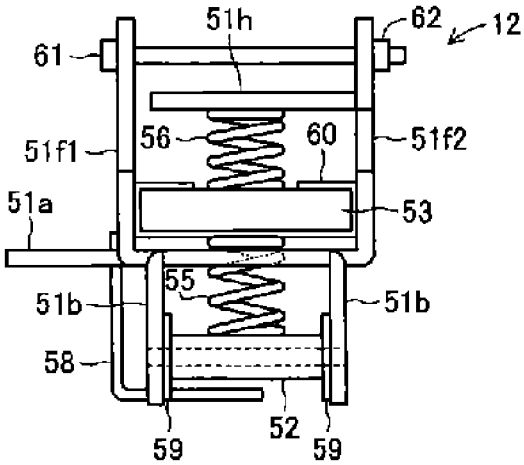
FIG. 3C is a rear view of the reaction force generating mechanism indicated in FIG. 3A.

Above the rear part of the lever 40, a reaction force generating mechanism 50 for generating a reaction force that resists manipulation of the lever is provided. As indicated in FIG. 3A to FIG. 3C, the reaction force generating mechanism 50 is formed of a base member 51, a first pivoting member 52, a second pivoting member 53, a spring 54 for stabilizing reaction force to be exerted on the lever 40, and a first spring 55 and a second spring 56 for changes to spring constant. The first pivoting member 52 and the drive rod 45 serve as the conveying member of the present invention, while the second pivoting member 53 serves as the movable member of the present invention.

The base member 51 has a first supporting portion 51*b* and a second supporting portion 51*d* which support the first pivoting member 52 and the second pivoting member 53 respectively. The base member 51 also has a mounting portion 51*a* for mounting the reaction force generating mechanism 50 on the shelf board 39 of the electronic musical instrument 10. The mounting portion 51*a*, the first supporting portion 51*b* and the second supporting portion 51*d* are provided integrally.

The first pivoting member 52 is shaped like a plate extending frontward and backward. A rear part of the first pivoting member 52 is supported by the first supporting portion 51*b* provided on the undersurface of a rear part of the base member 51 so that the front end of the first pivoting member 52 can pivot upward and downward about a rotary shaft 51*c*. The first supporting portion 51*b* includes vertical plates extending downward from the right and left edges of the rear part of the mounting portion 51*a*. The two vertical plates of the first supporting portion 51*b* interpose the first pivoting member 52 inbetween to support the first pivoting member 52. On the inner surface of each vertical plate, a friction generating member 59 such as artificial leather or felt is fixed so that each friction generating member 59 is in contact with each side surface of the first pivoting member 52. The first supporting portion 51*b* of the base member 51 and the friction generating member 59 serve as the first contact member of the present invention.

An upward displacement of the front end of the first pivoting member 52 is restricted by the base member 51. On the top surface of the front end of the first pivoting member 52, a first pivoting member upper limit stopper 57 is provided. The first pivoting member upper limit stopper 57 is made of an impact absorber such as rubber or felt to alleviate impact noise caused by collision of the first pivoting member 52 with the base member 51. On the undersurface of the base member 51, a first pivoting member lower limit stopper 58 is provided. The first pivoting member lower limit stopper 58 is a rodlike member extending downward from the undersurface of the base member 51. A midpoint of the first pivoting member lower limit stopper 58 is bent in the horizontal direction. In a state where the lever 40 is not depressed, therefore, the undersurface of the forward part of the first pivoting member 52 is in contact with the first pivoting member lower limit stopper 58, so that the downward displacement of the first pivoting member 52 is restricted by the first pivoting member lower limit stopper 58. In this state, the top surface of the first pivoting member 52 is in parallel with the undersurface of the shelf board 39 of the electronic musical instrument. In addition, the top end of the drive rod 45 is inserted into a concave portion 52*a* provided on the undersurface of the first pivoting member 52 to be in contact with the upper base of the concave portion 52*a*.

On the top surface of the base member 51, the second pivoting member 53 is provided. Similarly to the first pivoting member 52, the second pivoting member 53 is also shaped like a plate extending frontward and backward. A rear part of the second pivoting member 53 is supported by the second supporting portion 51*d* provided on the top surface of the base member 51 so that the front end of the second pivoting member 53 can pivot upward and downward about a rotary shaft 51*e*. The second supporting portion 51*d* includes vertical plates extending upward from the right and left edges of the rear part of the mounting portion 51*a*. The two vertical plates of the second supporting portion 51*d* interpose the second pivoting member 53 inbetween to support the second pivoting member 53.

Around a midpoint of the second pivoting member 53, a friction generating member 60 such as artificial leather or felt is wound rigidly. The friction generating member 60 is included in the second pivoting member 53. On the top surface of a midpoint of the mounting portion 51*a*, a contact portion 51*f* for producing friction by contact with the friction generating member 60 is provided. The contact portion 51*f* is formed of vertical plates 51*f*1, 51*f*2 extending upward from the right and left edges of the mounting portion 51*a* to interpose the second pivoting member 53 between the right and left vertical plates 51*f*1, 51*f*2 so that the friction generating member 60 is in contact with the vertical plates 51*f*1, 51*f*2. The vertical plate 51*f*2 is wider in the frontward and backward direction than the vertical plate 51*f*1. The contact portion 51*f* of the base member 51 serves as the second contact member of the present invention.

Each of the vertical plates 51/1, 51/2 has a hole at an upper edge of the vertical plate so that the both holes oppose each other. From the vertical plate 51/1, a bolt 61 extends toward the vertical plate 51/2 through the holes. The bolt 61 is screwed into a nut 62 provided at the outside of the vertical plate 51/2. By tightening the bolt 61, the vertical plates 51/1, 51/2 are deformed to allow adjustment of the space between the vertical plates 51/1, 51/2. The adjustment of the space between the vertical plates 51/1, 51/2 allows adjustment of friction to be applied to the second pivoting member 53. The vertical plates 51/1, 51/2, the bolt 61 and the nut 62 serve as the friction-adjustment mechanism of the present invention.

A downward displacement of the front end of the second pivoting member 53 is restricted by the base member 51. On the top surface of a forward part of the base member 51, a second pivoting member lower limit stopper 63 is provided. The second pivoting member lower limit stopper 63 is also made of an impact absorber such as rubber or felt to prevent impact noise caused by collision of the second pivoting member 53 with the base member 51. The base member 51 has a top board portion 51*h* extending in the horizontal direction from the top end of a forward part of the vertical plate 51/2. An upward displacement of the front end of the second pivoting member 53 is restricted by the top board 51*h* of the base member 51. On the undersurface of the top board 51*h*, a second pivoting member upper limit stopper 64 is provided. The second pivoting member upper limit stopper 64 is also made of an impact absorber such as rubber or felt to alleviate impact noise caused by collision of the second pivoting member 53 with the top board portion 51*h*.

Into a concave portion 52*b* provided on the top surface of a forward part of the first pivoting member 52, the lower end of the reaction force stabilization spring 54 is inserted so that lower end of the spring 54 is rigidly supported by the bottom surface of the concave portion 52*b*. The top end of the reaction force stabilization spring 54 is rigidly supported by the base member 51 provided upward. The reaction force stabilization spring 54 is a compression spring. The reaction force stabilization spring 54 urges the front end of the lever 40 upward through the drive rod 45. Into a concave portion 52*c* provided on the top surface of a midpoint of the first pivoting member 52, the lower end of the first spring 55 is inserted to be rigidly supported by the bottom surface of the concave portion 52*c*. At a midpoint of the mounting portion 51*a*, a penetrating hole 51*g* which penetrates from the top surface to the undersurface of the mounting portion 51*a* is provided. The first spring 55 passes through the penetrating hole 51*g* so that the top end of the first spring 55 is in contact with the undersurface of the second pivoting member 53. The first spring 55 is also a compression spring.

Into a concave portion 53*a* provided on the top surface of a forward part of the second pivoting member 53, the lower end of the second spring 56 is inserted to be rigidly supported by the bottom surface of the concave portion 53*a*. The top end of the second spring 56 is rigidly connected to the undersurface of the top board portion 51*h* of the base member 51. The second spring 56 is a compression spring. As for comparison of spring constant among the reaction force stabilization spring 54, the first spring 55 and the second spring 56, the reaction force stabilization spring 54 has the largest spring constant. The spring constant of the second spring 56 is adequately smaller than that of the reaction force stabilization spring 54 and that of the first spring 55. The respective magnitudes of spring constant of the reaction force stabilization spring 54, the first spring 55 and the second spring 56 are not limited to those of the present embodiment but can vary according to target characteristics of reaction force of the lever 40. In a case where the difference in rate of change in the reaction force is small between range A1 and range A2 of FIG. 12, for example, the second spring 56 may have a larger spring constant than that of the first spring 55. The spring 54 for stabilizing reaction force of the lever 40 corresponds to the third spring of the present invention, while the first and second springs 55, 56 for varying spring constant correspond to the first and second springs of the present invention, respectively.

Above a midpoint of the lever 40, a displacement sensor 66 which senses the amount of displacement of the lever 40 and serves as the sensor of the present invention is provided. The displacement sensor 66 electrically or optically (by reflection of laser light, for example) senses the distance to the top surface of the lever 40 to obtain the amount of displacement of the lever 40. The displacement sensor 66 may be replaced with a sensor which mechanically and electrically (by variable resistance, for example) senses the amount of upward/downward displacement of the lever 40.

The shelf board 39 of the electronic musical instrument 10 has a penetrating hole 67 which penetrates from the top surface to the undersurface of the shelf board 39. The first pivoting member 52, the second pivoting member 53, the reaction force stabilization spring 54, the first spring 55 and the second spring 56 are installed on the base member 51 before the second pivoting member 53 is inserted through the penetrating hole 67. Then, the top surface of the mounting portion 51*a* of the base member 51 is made contact with the undersurface of the shelf board 39 to connect the base member 51 with the undersurface of the shelf board 39 with a screw 68. The above-described embodiment is designed such that the direction of the length of the reaction force generating mechanism 50 coincides with the direction of the length of the lever 40. However, the orientation of the reaction force generating mechanism 50 is not limited to that of the embodiment but may be arranged, for example, such that the direction of the length of the reaction force generating mechanism 50 is orthogonal to the direction of the length of the lever 40.

Next, the operation of the pedal apparatus 12 configured as described above will be explained. In a state where the lever 40 is not depressed, the first pivoting member 52 is urged downward by the urging force of the reaction force stabilization spring 54 and the weight of the first pivoting member 52. The urged first pivoting member 52 causes the rear part of the lever 40 to be urged downward through the drive rod 45. As a result, the undersurface of the rear part of the lever 40 is in contact with the upper limit stopper 44, so that the lever 40 stands still to be in a state shown in FIG. 3A. In this state, the first spring 55 is in its natural length, resulting in the urging force exerted on the lever 40 of "0". In this state, furthermore, the second pivoting member 53 is in contact with the second pivoting member lower limit stopper 63 by the urging force of the second spring 56 and the weight of the second pivoting member 53. In this state, although the first spring 55 may be slightly compressed to urge the lever 40 through the drive rod 45, the urging force of the first spring 55 is to be designed to be smaller than a combined force formed of the urging force of the second spring 56, the weight of the second pivoting member 53 and the static friction force of the second pivoting member 53 so that the second pivoting member 53 is in contact with the second pivoting member lower limit stopper 63.

Figure 4A:
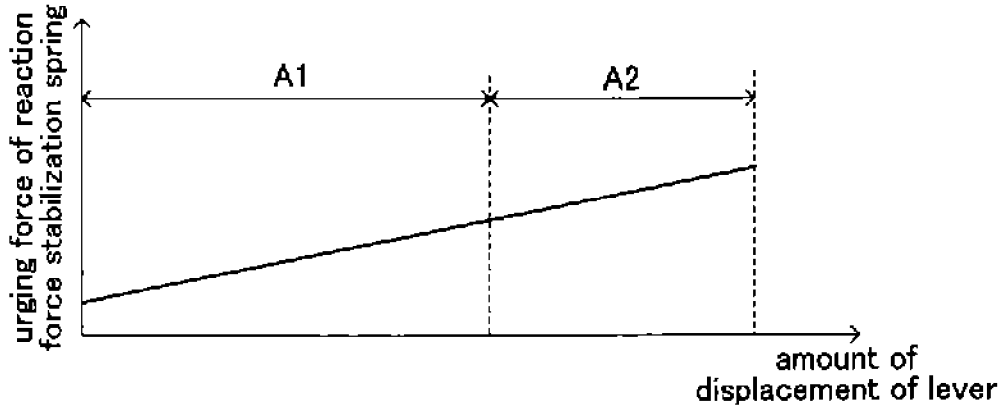
FIG. 4A is a graph indicating characteristics of varying urging force of a reaction force stabilization spring in accordance with the amount of displacement of a lever of the pedal apparatus of FIG. 3A.
Figure 4B:
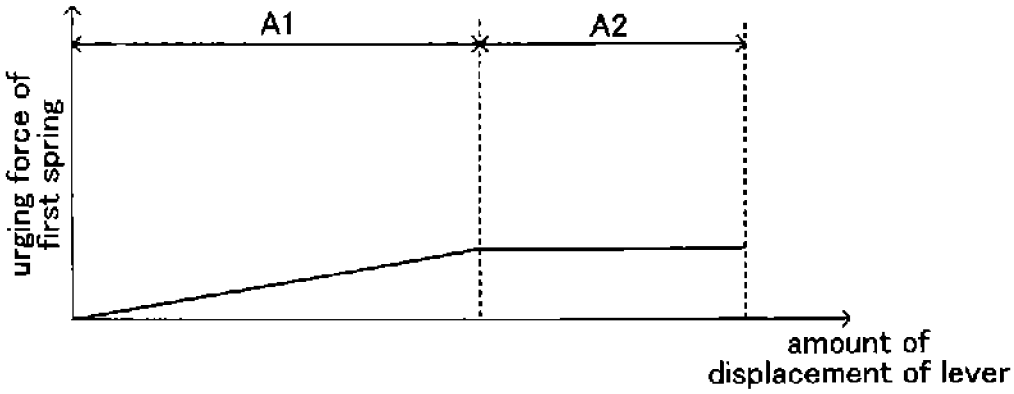
FIG. 4B is a graph indicating characteristics of varying urging force of a first spring in accordance with the amount of displacement of the lever of the pedal apparatus of FIG. 3A.
Figure 5A:
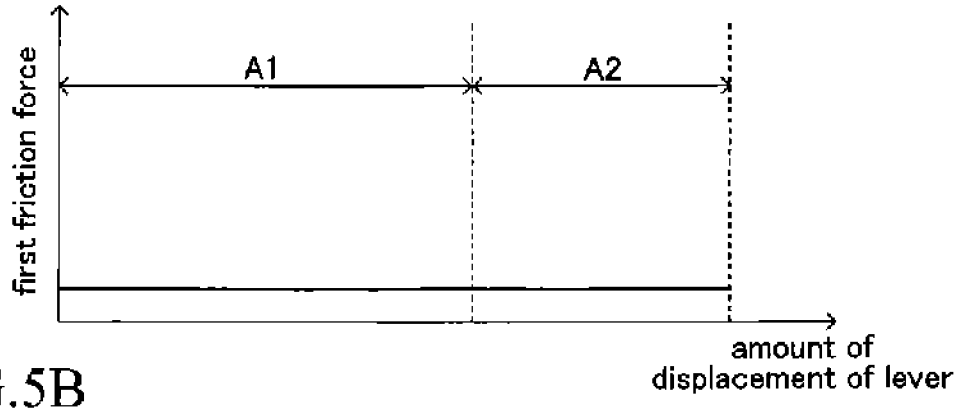
FIG. 5A is a graph indicating concept of characteristics of a first friction force with respect to the amount of displacement of the lever of the pedal apparatus of FIG. 3A.

If the player depresses the lever 40 in spite of a combined force formed of the urging force of the reaction force stabilization spring 54, the weight of the first pivoting member 52 and the static friction force of the first pivoting member 52, the lever 40 starts pivoting counterclockwise about the rotary shaft 42 in FIG. 3A, so that the rear part of the lever 40 is displaced upward. The upper displacement of the lever 40 causes the drive rod 45 to displace the front end of the first pivoting member 52 upward. As a result, the reaction force stabilization spring 54 compresses to increase the urging force exerted on the lever 40 by the reaction force stabilization spring 54 (A1 of FIG. 4A). If the urging force exerted by the first spring 55 is smaller than the combined force formed of the urging force of the second spring 56, the weight of the second pivoting member 53 and the static friction force of the second pivoting member 53, furthermore, the second pivoting member 53 remains to be in contact with the second pivoting member lower limit stopper 63. As a result, the first spring 55 also starts compressing to increase the urging force of the first spring 55 as well (A1 of FIG. 4B). On the first pivoting member 52, furthermore, a first friction force is produced in the direction which restrains the pivoting (A1 of FIG. 5A). The direction in which the first friction force is exerted is the direction which resists the depression of the lever 40. The magnitude of the first friction force is constant independently of the amount of depression of the lever 40. In this operational range, therefore, the reaction force of the lever 40 is brought about by the reaction force stabilization spring 54, the first spring 55 and the first friction force (A1 of FIG. 6). The changes in the reaction force are brought about by the reaction force stabilization spring 54 and the first spring 55.

Figure 4C:
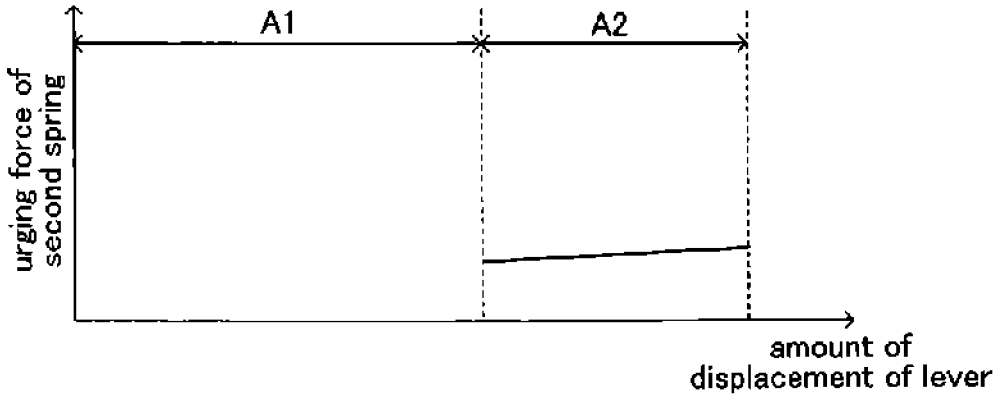
FIG. 4C is a graph indicating characteristics of varying urging force of a second spring in accordance with the amount of displacement of the lever of the pedal apparatus of FIG. 3A.
Figure 5B:
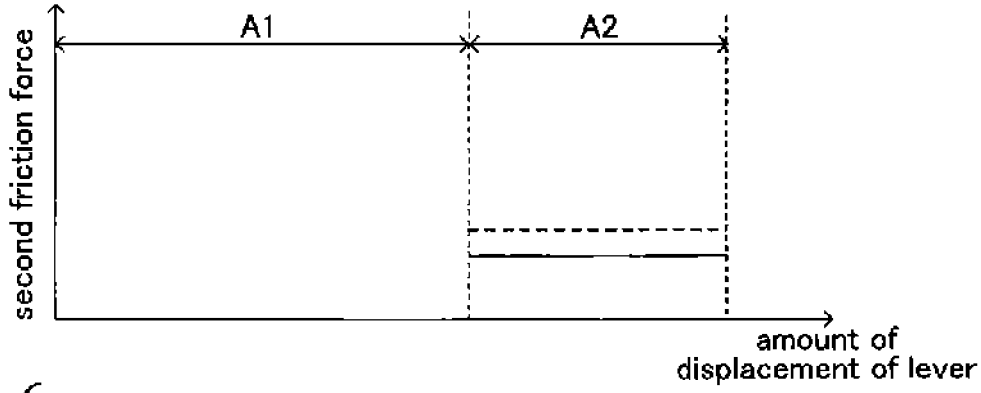
FIG. 5B is a graph indicating concept of characteristics of a second friction force with respect to the amount of displacement of the lever of the pedal apparatus of FIG. 3A.

Then, if the urging force of the first spring 55 exceeds the combined force formed of the urging force of the second spring 56, the weight of the second pivoting member 53 and the static friction force of the second pivoting member 53, the second pivoting member 53 moves upward. As described above, the spring constant of the second spring 56 is sufficiently smaller than that of the first spring 55. If the amount of displacement of the lever 40 increases, therefore, the second spring 56 is compressed to increase the urging force of the second spring 56 (A2 of FIG. 4C). However, the first spring 55 will be hardly compressed any further with little increase in the urging force of the first spring 55 (A2 of FIG. 4B). On the first pivoting member 52 and the second pivoting member 53, furthermore, the first friction force and a second friction force are produced, respectively, in the direction which restrains the pivoting of the respective pivoting members (A2 of FIG. 5A and FIG. 5B). The direction in which the first friction force and the second friction force are exerted is the direction which resists the depression of the lever 40. The magnitude of the first friction force and the second friction force is constant independently of the amount of depression of the lever 40. The second friction force is larger than the first friction force. In this operational range, therefore, the reaction force of the lever 40 is brought about by the reaction force stabilization spring 54, the first spring 55, the second spring 56, the first friction force and the second friction force. The magnitude of the second friction force can be adjusted by the above-described friction-adjustment mechanism. By tightening the bolt 60 to narrow the interval between the vertical plates 51/1, 51/2, for instance, the second friction force can be increased as shown by a dashed line in FIG. 5B. However, it is required to adjust the magnitude of the second friction force such that a combined force formed of the second friction force and the urging force of the second spring 56 will not exceed the urging force of the first spring 55. Strictly speaking, the change in the reaction force in this operational range is brought about by the reaction force stabilization spring 54, the first spring 55 and the second spring 56. However, the spring constant of the second spring 56 is sufficiently smaller than that of the first spring 55, resulting in little compression of the first spring 55 and little increase in the urging force of the first spring 55. Therefore, it can be considered that the change in the reaction force is brought about by the reaction force stabilization spring 54 and the second spring 56 (A2 of FIG. 6).

Then, the undersurface of the middle part of the lever 40 comes into contact with the lower limit stopper 43 to restrict downward displacement of the forward part of the lever 40. If the depression of the lever 40 is released, the urging forces exerted by the reaction force stabilization spring 54, the first spring 55 and the second spring 56 cause the lever 40 to operate in the order opposite to that in which the lever 40 has operated on the depression of the lever 40. More specifically, the lever 40 pivots clockwise about the rotary shaft 42 in FIG. 3A, so that the undersurface of the rear part of the lever 40 comes into contact with the upper limit stopper 44 to recover to the original state (FIG. 3A). The direction of the first and second friction forces in the respective operational ranges is the direction which helps the depression of the lever 40. As a result, the reaction force can be reduced during the release of the lever 40, compared with the depression of the lever 40. In the above-described explanation, the weight of the first pivoting member 52 and the second pivoting member 53 is taken into account. In a case where the first pivoting member 52 and the second pivoting member 53 are made of a light material such as resin, however, the weight of these pivoting members can be ignored.

The detection circuit 23 detects the amount of displacement of the lever 40 by use of the displacement sensor 66. In accordance with the information on the amount of displacement of the lever 40, the electronic musical instrument 10 adds a damper effect or a shift effect to a musical tone to be generated, also controlling musical tone elements such as timbre and resonance (acoustic effect) of the musical tone to be generated. In a case where the present invention is applied to a damper pedal 12*a*, particularly, in a range AH of FIG. 6 corresponding to the above-described half pedal range AH of FIG. 12, on the basis of the amount of displacement detected by the displacement sensor 66, the tone generator 15 and the effect circuit 26 subtly change the musical tone elements such as timbre and resonance (acoustic effect) of musical tones to be generated in accordance with pedal manipulation of the player.

Figure 12:
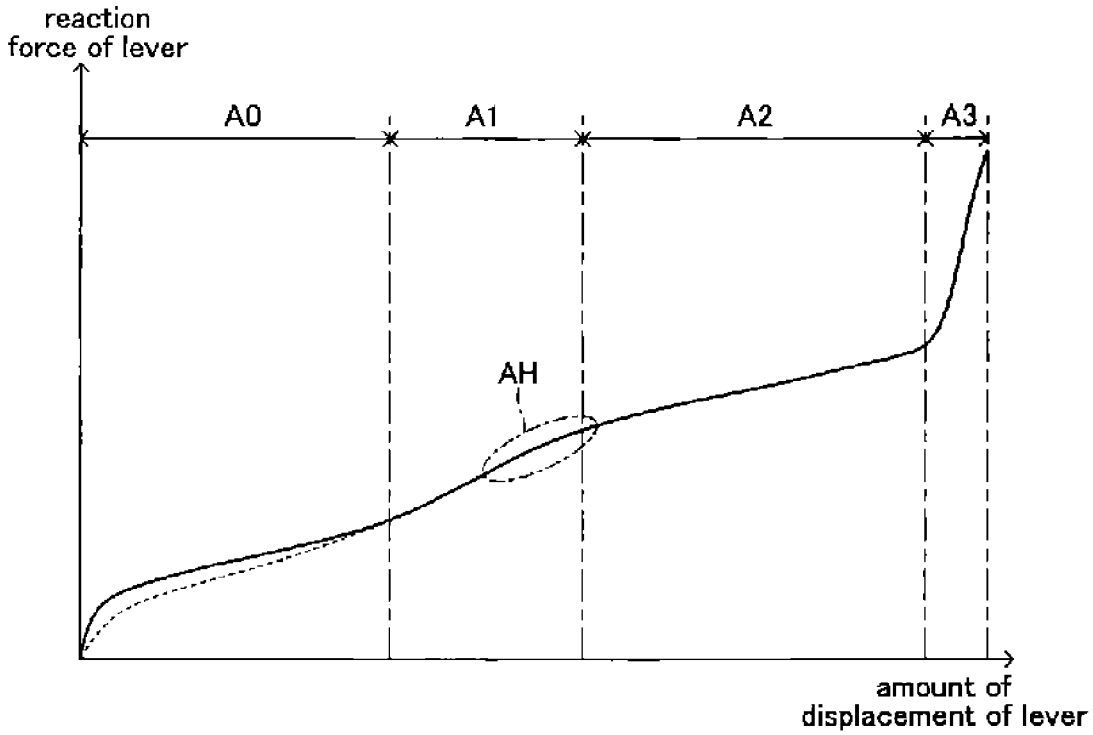
FIG. 12 is a graph indicating characteristics of rate of change in the reaction force of a lever of an acoustic piano with respect to the amount of displacement of the lever.

The pedal apparatus 12 configured as described above can achieve the characteristics (FIG. 6) similar to those of the relationship between the amount of displacement of the lever from the start to the end of a depression of a pedal of an acoustic piano and the reaction force perceived by the player through the pedal as shown by a dashed line in A0 range and by a solid line in A1 through A3 ranges in FIG. 12. In the operational range (A1 of FIG. 6) equivalent to A0 and A1 of FIG. 12, more specifically, the urging force exerted by the reaction force stabilization spring 54 and the first spring 55 to urge the lever 40 changes, whereas in the operational range (A2 of FIG. 6) equivalent to A2 of FIG. 12, the urging force exerted by the second spring 56 changes in addition to the urging force of the reaction force stabilization spring 54. Because the spring constant of the second spring 56 is sufficiently smaller than that of the first spring 55, the rate of change in the reaction force in the operational range (A2 of FIG. 6) equivalent to the range of A2 of FIG. 12 can be reduced, compared with the operational range (A1 of FIG. 6) equivalent to the range of A1 of FIG. 12. Even if the spring constant of the second spring 56 is not sufficiently smaller than that of the first spring 55, or is larger than that of the first spring 55, in the operational range (A2 of FIG. 6) equivalent to the range of A2 of FIG. 12, the serial connection of the first spring 55 and the second spring 56 results in the spring constant of the combined springs of the first spring 55 and the second spring 56 being smaller than the spring constant of the first spring 55. In this case as well, therefore, the rate of change in the reaction force in the operational range (A2 of FIG. 6) can be reduced, compared with the rate of change in the reaction force of the operational range (A1 of FIG. 6) equivalent to the range of A1 of FIG. 12.

Figure 6:
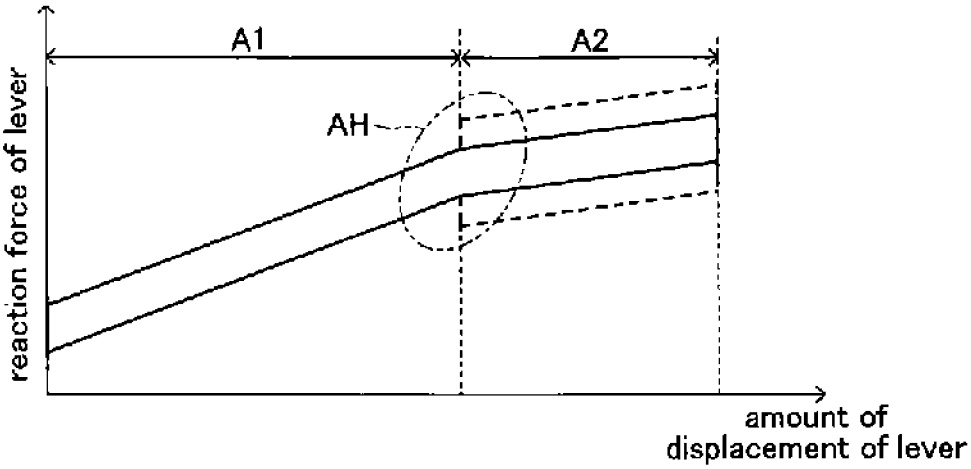
FIG. 6 is a graph indicating concept of characteristics of varying reaction force of the lever in accordance with the amount of displacement of the lever of the pedal apparatus of FIG. 3A.

Because of the adoption of the first supporting portion 51*b* and the contact portion 51*f* which are in contact with the first pivoting member 52 and the second pivoting member 53, respectively, to produce the friction force in the direction which restrains the pivoting of the respective pivoting members, the present invention is able to reduce the reaction force during the release of the lever 40, compared with the depression of the lever 40, as shown in FIG. 6. Between the depression of the lever 40 and the release of the lever 40, more specifically, the present invention is able to exhibit hysteresis in the reaction force of the lever 40, the hysteresis being similar to that exhibited by an acoustic piano shown in FIG. 13.

Figure 13:
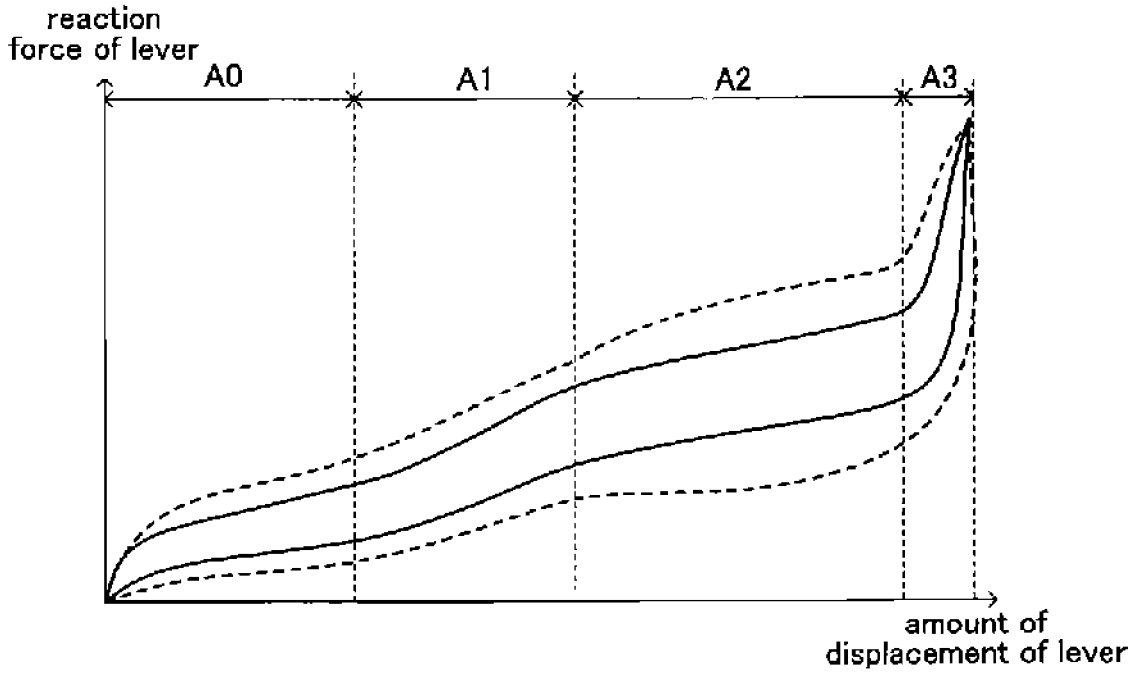
FIG. 13 is a graph indicating characteristics of hysteresis in varying reaction force of the lever of the acoustic piano according to the amount of displacement of the lever.

Furthermore, the pedal apparatus 12 configured as described above enables adjustment of the friction force which is to be produced on the second pivoting member 53 by adjustment of the interval between the vertical plates 51*f*1, 51*f*2. As indicated by dashed lines in FIG. 6, as a result, this embodiment is able to change the width of the hysteresis of only the operational range of A2 of FIG. 6 to realize both of the different reaction force characteristics of the damper pedal and the shift pedal of an acoustic pedal as shown in FIG. 13 with a single configuration.

As for the acoustic piano, the range of A3 of FIG. 12 indicates a relationship between the amount of displacement of the lever caused by the lever and a linkage mechanism coming into contact with various stopper members to slightly compress the stopper members and the reaction force. This range is equivalent to a state of the pedal apparatus 12 of the present embodiment where the undersurface of the forward part of the lever 40 is in contact with the lower limit stopper 43. Therefore, the pedal apparatus 12 of the embodiment can realize the characteristics of the reaction force of the acoustic piano of a case where there is no difference in the rate of change in the reaction force between the ranges A0, A1 of FIG. 12.

In a case where the player deeply depresses the lever 40 and then sharply decreases the amount of depression, and in a case where the player periodically changes the amount of depression of the lever 40, the second pivoting member 53 can temporarily oscillate due to collaboration of inertial force and spring force applied to the second pivoting member 53. Furthermore, the second pivoting member 53 can collide with the second pivoting member lower limit stopper 63 to cause oscillation of the second pivoting member 53. In a case where the player periodically changes the amount of depression of the lever 40 in the neighborhood of the range AH of FIG. 6, particularly, if the frequency of the periodic changes is close to the natural frequency of the first spring 55 or the second spring 56, the amplitude of the second pivoting member 53 can grow to cause periodic collision of the second pivoting member 53 with the second pivoting member lower limit stopper 63. The oscillation of the second pivoting member 53 is conveyed to the lever 40 through the first spring 55 to be perceived by the player as unnatural reaction force. As for the pedal apparatus 12 configured as described above, however, the respective spring forces of the first spring 55 and the second spring 56 act on the second pivoting member 53 in the directions opposite to each other. Therefore, the pedal apparatus 12 is able to suppress or quickly cease the oscillation. Furthermore, because the force of the springs acting on the lever 40 is divided into the spring force exerted by the reaction force stabilization spring 54, and the spring force exerted by the first spring 55 and the second spring 56, the spring force exerted by the first spring 55 and the second spring 56 is small. Therefore, the pedal apparatus 12 is able to reduce unnatural reaction force conveyed to the lever 40 through the first spring 55. Furthermore, the contact portion 51*f* produces the friction force on the second pivoting member 53 in the direction which suppresses or quickly ceases the oscillation. As a result, the unnatural reaction force of the lever caused by the oscillation can be reduced. Therefore, the pedal apparatus 12 configured as described above can stabilize the reaction force of the lever 40.

In the above description, the weight of the second pivoting member 53 is taken into account. However, if the second pivoting member 53 is made of a light material such as resin, the weight of the second pivoting member 53 can be ignored. In this case, because the inertial force acting on the second pivoting member 53 can be also ignored, such a light second pivoting member 53 prevents the unnatural reaction force, also achieving reduction in weight of the pedal apparatus 12.

Furthermore, the pedal apparatus 12 is provided with the displacement sensor 66 placed right above the lever 40, enabling direct sensing of the amount of displacement of the lever 40. The friction force to be produced on the first pivoting member 52 is small. Therefore, a release of the depressed lever 40 causes the first pivoting member 52, the drive rod 45 and the lever 40 to return to their initial positions. If the player releases the depressed lever 40, therefore, the pedal apparatus 12 reliably cancels the addition of the damper effect and the shift effect to musical tones to be generated.

The first pivoting member 52, the second pivoting member 53, the reaction force stabilization spring 54, the first spring 55 and the second spring 56 are installed on the base member 51 before the base member 51 is installed into the electronic musical instrument 10. Therefore, the installation of the pedal apparatus into the electronic musical instrument 10 is easy. Furthermore, this embodiment is designed such that the second pivoting member 53 is provided on the top surface of the base member 51 with the first pivoting member 52 being provided on the undersurface of the base member 51 so that the installation of the reaction force generating mechanism 50 on the electronic musical instrument 10 results in the second pivoting member 53 being inserted into the electronic musical instrument 10 with the first pivoting member 52 being situated outside the electronic musical instrument 10. Such an arrangement of the components reduces the amount of components of the reaction force generating mechanism 50 protruding from undersurface of the shelf board 39, resembling the appearance of an acoustic piano (grand piano).

The mounting portion 51*a*, the first supporting portion 51*b* and the second supporting portion 51*d* are formed integrally. The integral formation allows reduction in component count and reduction in workload of assembly processes, also contributing to cost-reduction.

Figure 3D:
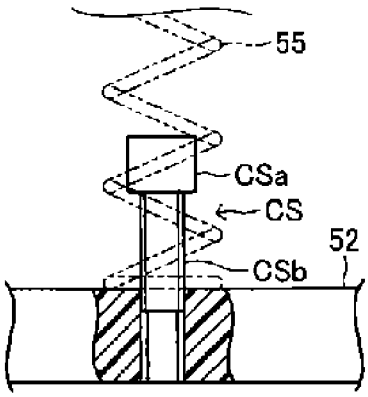
FIG. 3D is an enlarged view of a portion where a capstan is mounted according to a modification of the first embodiment.

As shown in FIG. 3D, furthermore, a capstan CS may be added to the above-described embodiment. The capstan CS has a cylindrical head portion CSa. Downward from the undersurface of the head portion CSa, a screw portion CSb whose diameter is slightly smaller than that of the head portion CSa extends. With a screw hole being provided on the top surface of the first pivoting member 52, the screw portion CSb is screwed into the screw hole to connect the capstan CS to the pedal apparatus 12. The capstan CS is designed to have an outer diameter smaller than the interior diameter of the first spring 55 so that the central axis of the first spring 55 is overlaid with the central axis of the capstan CS. In other words, the capstan CS is situated inside the first spring 55. In a state where the lever 40 is not depressed, the top end of the head portion CSa is apart from the second pivoting member 53 to oppose to the undersurface of the second pivoting member 53. The length of the capstan CS is adjusted such that when the lever 40 is depressed to balance between the combined force formed of the urging force of the second spring 56 and the weight of the second pivoting member 53 and the urging force of the first spring 55, the capstan CS comes into contact with the undersurface of the second pivoting member 53.

In the case where the pedal apparatus 12 is configured as described above, while the second pivoting member 53 is apart from the second pivoting member lower limit stopper 63 to be displaced upward, the second pivoting member 53 is supported by the capstan CS to prevent further compression of the first spring 55. Therefore, the second pivoting member 53 can stably move upward and downward, resulting in stable reaction force exerted on the lever 40.

The length of the capstan CS may be adjusted such that before the urging force of the first spring 55 exceeds the weight of the second pivoting member 53 after the depression of the lever 40, the capstan CS comes into contact with the undersurface of the second pivoting member 53.

Although the above-described modifications are designed such that the capstan CS is situated inside the first spring 55, the capstan CS may be placed anywhere as long as the top end of the capstan CS opposes to the undersurface of the second pivoting member 53. Alternatively, the capstan CS may be placed on the second pivoting member 53 side so that the head portion CSa of the capstan CS opposes to the top surface of the lever 40. In this case, the capstan CS is fixed to the undersurface of the second pivoting member 53.

c. Second Embodiment

Figure 7:
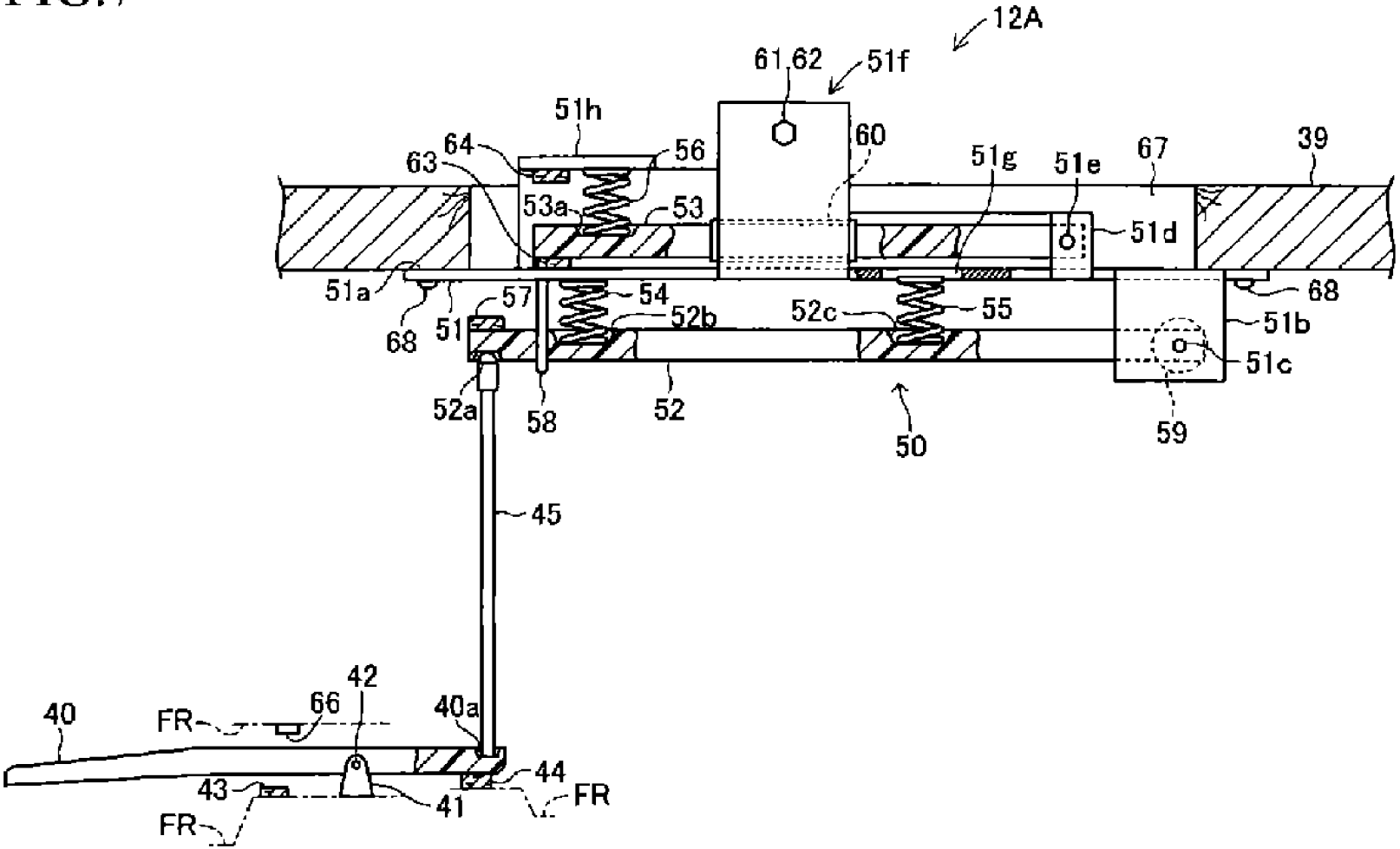
FIG. 7 is a side view of a pedal apparatus according to the second embodiment of the present invention.

Next, the second embodiment of the pedal apparatus according to the present invention will be described in detail. FIG. 7 is a side view of a pedal apparatus 12A of the present embodiment. This embodiment is configured almost similarly to the first embodiment shown in FIG. 3A. Unlike the first embodiment, however, in a state where the lever 40 is not depressed, the upper end of the first spring 55 is apart from the second pivoting member 53.

Figure 9A:
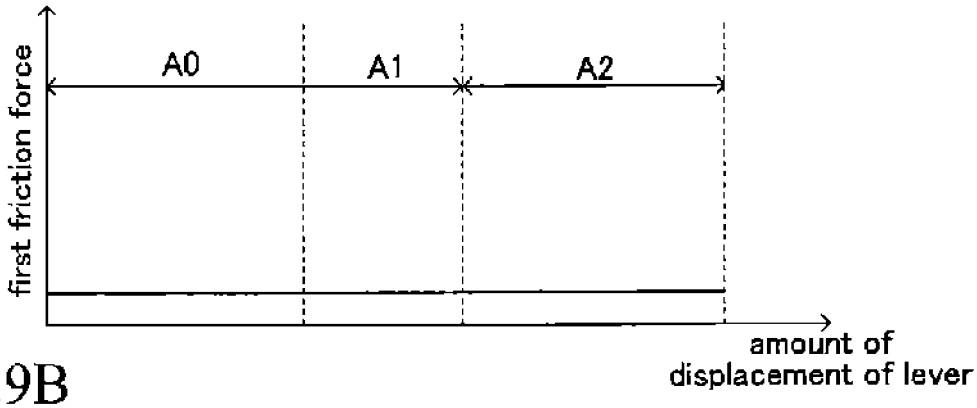
FIG. 9A is a graph indicating concept of characteristics of the first friction force with respect to the amount of displacement of the lever of the pedal apparatus of FIG. 7.
Figure 9B:
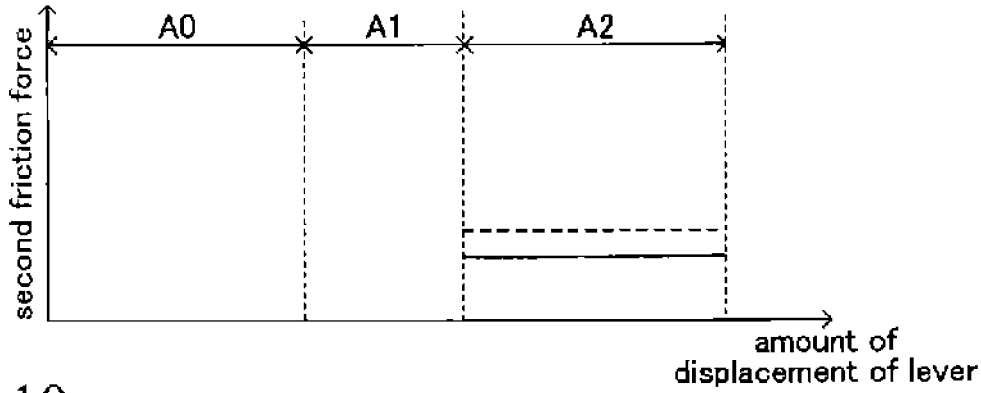
FIG. 9B is a graph indicating concept of characteristics of the second friction force with respect to the amount of displacement of the lever of the pedal apparatus of FIG. 7.
Figure 10:
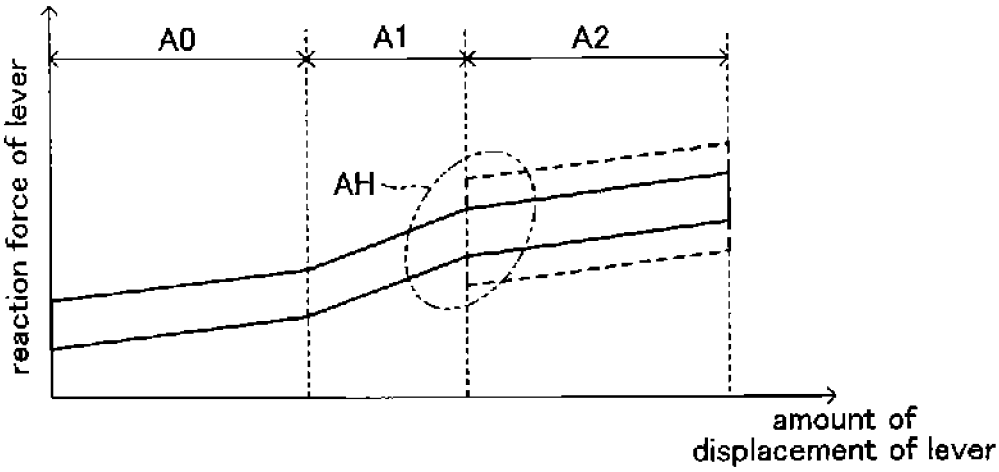
FIG. 10 is a graph indicating concept of characteristics of varying reaction force of the lever in accordance with the amount of displacement of the lever of the pedal apparatus of FIG. 7.

Next, the operation of the pedal apparatus 12A configured as described above will be explained. In a state where the lever 40 is not depressed, similarly to the first embodiment, the pedal apparatus 12A is designed to be a state of FIG. 7. If the player depresses the lever 40 in spite of the combined force formed of the urging force of the reaction force stabilization spring 54, the weight of the first pivoting member 52 and the static friction force of the first pivoting member 52, the lever 40 starts pivoting counterclockwise about the rotary shaft 42 in FIG. 7, so that the rear part of the lever 40 is displaced upward. The upper displacement of the lever 40 causes the drive rod 45 to displace the front end of the first pivoting member 52 upward. As a result, the reaction force stabilization spring 54 compresses to increase the urging force exerted on the lever 40 by the reaction force stabilization spring 54 (A0 of FIG. 8A). In this state, the top end of the first spring 55 is apart from the undersurface of the second pivoting member 53. On the first pivoting member 52, furthermore, the first friction force is produced in the direction which restrains the pivoting (A0 of FIG. 9A). The direction in which the first friction force is exerted is the direction which resists the depression of the lever 40. The magnitude of the first friction force is constant independently of the amount of depression of the lever 40. In this operational range, therefore, the reaction force of the lever 40 is brought about by the reaction force stabilization spring 54 and the first friction force (A0 of FIG. 10). The changes in the reaction force are brought about by the reaction force stabilization spring 54.

Figure 8A:
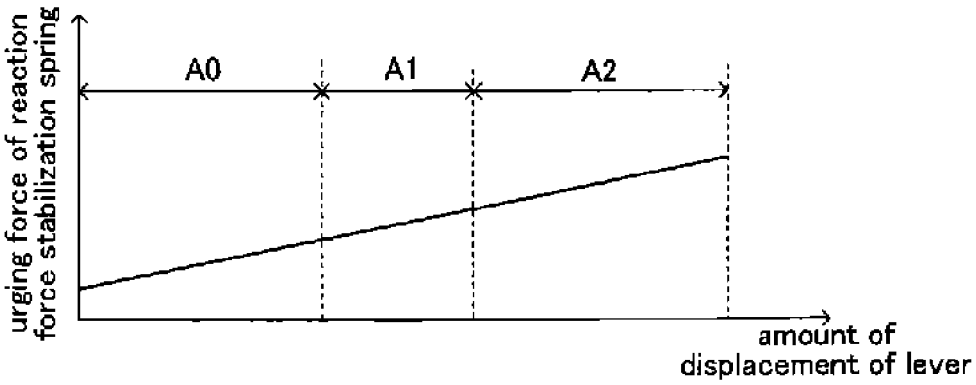
FIG. 8A is a graph indicating characteristics of varying urging force of the reaction force stabilization spring in accordance with the amount of displacement of the lever of the pedal apparatus of FIG. 7.
Figure 8B:
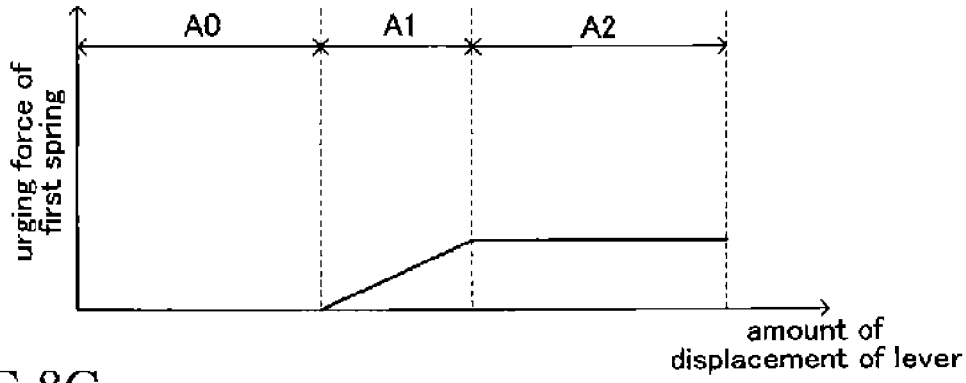
FIG. 8B is a graph indicating characteristics of varying urging force of the first spring in accordance with the amount of displacement of the lever of the pedal apparatus of FIG. 7.
Figure 8C:
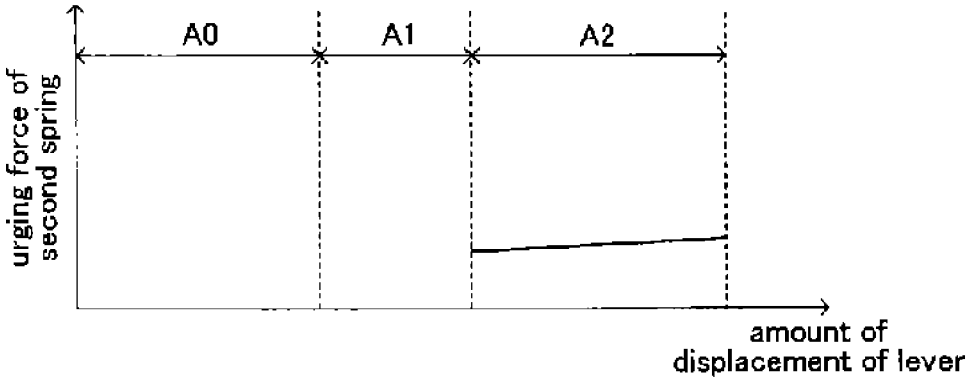
FIG. 8C is a graph indicating characteristics of varying urging force of the second spring in accordance with the amount of displacement of the lever of the pedal apparatus of FIG. 7.

If the lever 40 is depressed further to increase the amount of displacement of the lever 40, the urging force exerted on the lever 40 by the reaction force stabilization spring 54 also increases further (A1 of FIG. 8A). The top end of the first spring 55 comes into contact with the undersurface of the second pivoting member 53. If the contact of the top end of the first spring 55 with the undersurface of the second pivoting member 53 is followed by a further increase in the amount of depression of the lever 40, the pedal apparatus 12A operates similarly to that of the first embodiment.

The pedal apparatus 12A according to the present embodiment configured as described above can achieve the characteristics (FIG. 10) similar to those of the relationship between the amount of displacement of the lever from the start to the end of a depression of a pedal of an acoustic piano and the reaction force perceived by the player through the pedal as shown by the solid line in FIG. 12. In the operational range (A0 of FIG. 10) equivalent to A0 of FIG. 12, more specifically, the urging force exerted by the reaction force stabilization spring 54 to urge the lever 40 changes, whereas in the operational range (A1 of FIG. 10) equivalent to A1 of FIG. 12, the urging force exerted by the first spring 55 to urge the lever 40 changes in addition to the urging force of the reaction force stabilization spring 54. Therefore, the rate of change in the reaction force in the operational range (A1 of FIG. 10) equivalent to the range of A1 of FIG. 12 can be increased, compared with the operational range (A0 of FIG. 10) equivalent to the range of A0 of FIG. 12. In the operational range (A2 of FIG. 10) equivalent to A2 of FIG. 12, in addition to the urging force of the reaction force stabilization spring 54, the urging force exerted by the second spring 56 changes. Because the spring constant of the second spring 56 is sufficiently smaller than that of the first spring 55, the rate of change in the reaction force in the operational range (A2 of FIG. 10) equivalent to the range of A2 of FIG. 12 can be reduced, compared with the operational range (A1 of FIG. 10) equivalent to the range of A1 of FIG. 12. Even if the spring constant of the second spring 56 is not sufficiently smaller than that of the first spring 55, or is larger than that of the first spring 55, in the operational range (A2 of FIG. 10) equivalent to the range of A2 of FIG. 12, the serial connection of the first spring 55 and the second spring 56 results in the spring constant of the combined springs of the first spring 55 and the second spring 56 being smaller than the spring constant of the first spring 55. In this case as well, therefore, the rate of change in the reaction force in the operational range (A2 of FIG. 10) can be reduced, compared with the rate of change in the reaction force of the operational range (A1 of FIG. 10) equivalent to the range of A1 of FIG. 12.

Similarly to the first embodiment, furthermore, between the depression of the lever 40 and the release of the lever 40, the second embodiment is also able to exhibit hysteresis in the reaction force of the lever 40. In addition, the pedal apparatus 12A also allows adjustment of the friction force which is to be produced on the second pivoting member 53. As indicated by dashed lines in FIG. 10, as a result, the pedal apparatus 12A is able to change the width of the hysteresis of only the operational range of A2 of FIG. 10 to realize both of the different reaction force characteristics of the damper pedal and the shift pedal of an acoustic pedal as shown in FIG. 13 with a single configuration.

In this embodiment, similarly to the first embodiment, in a case where the player deeply depresses the lever 40 and then sharply decreases the amount of depression, and in a case where the player periodically changes the amount of depression of the lever 40, the second pivoting member 53 can temporarily oscillate due to collaboration of inertial force and spring force applied to the second pivoting member 53. Furthermore, the second pivoting member 53 can collide with the second pivoting member lower limit stopper 63 to cause oscillation of the second pivoting member 53. The oscillation of the second pivoting member 53 is conveyed to the lever 40 through the first spring 55 to be perceived by the player as unnatural reaction force. As for the pedal apparatus 12A configured as described above, however, the respective spring forces of the first spring 55 and the second spring 56 act on the second pivoting member 53 in the directions opposite to each other. Therefore, the pedal apparatus 12A is able to suppress or quickly cease the oscillation. Furthermore, because the force of the springs acting on the lever 40 is divided into the spring force exerted by the reaction force stabilization spring 54, and the spring force exerted by the first spring 55 and the second spring 56, the spring force exerted by the first spring 55 and the second spring 56 is small. Therefore, the pedal apparatus 12A is able to reduce unnatural reaction force conveyed to the lever 40 through the first spring 55. Furthermore, the contact portion 51*f* produces the friction force on the second pivoting member 53 in the direction which suppresses or quickly ceases the oscillation. Therefore, the pedal apparatus 12A configured as described above can stabilize the reaction force of the lever 40.

In the above description, the weight of the second pivoting member 53 is taken into account. However, if the second pivoting member 53 is made of a light material such as resin, the weight of the second pivoting member 53 can be ignored. In this case, because the inertial force acting on the second pivoting member 53 can be also ignored, such a light second pivoting member 53 prevents the unnatural reaction force, also achieving reduction in weight of the pedal apparatus 12A.

In addition, the displacement sensor 66 operates similarly to that employed in the first embodiment. If the player releases the depressed lever 40, therefore, the pedal apparatus 12A reliably cancels the addition of the damper effect and the shift effect to musical tones to be generated.

Furthermore, a capstan CS similar to that employed in the modification of the first embodiment may be provided between the second pivoting member 53 and the lever 40. Such a configuration is also able to stabilize the reaction force of the lever 40 as in the case of the modification of the first embodiment. Furthermore, the modification of the second embodiment may be designed such that the capstan CS comes into contact with the second pivoting member 53 before the urging force of the first spring 55 exceeds the combined force formed of the urging force of the second spring 56 and the weight of the second pivoting member 53.

The second embodiment is designed such that in the state where the lever 40 is not depressed, the lower end of the first spring 55 is inserted into the concave portion 52*c* provided on the first pivoting member 52 to be rigidly supported with the top end of the first spring 55 being apart from the undersurface of the second pivoting member 53. The second embodiment may be modified to provide a concave portion on the undersurface of the second pivoting member 53 so that the top end of the first spring 55 is inserted into the concave portion to be rigidly supported with the lower end of the first spring 55 being apart from the top surface of the first pivoting member 52.

Figure 11:
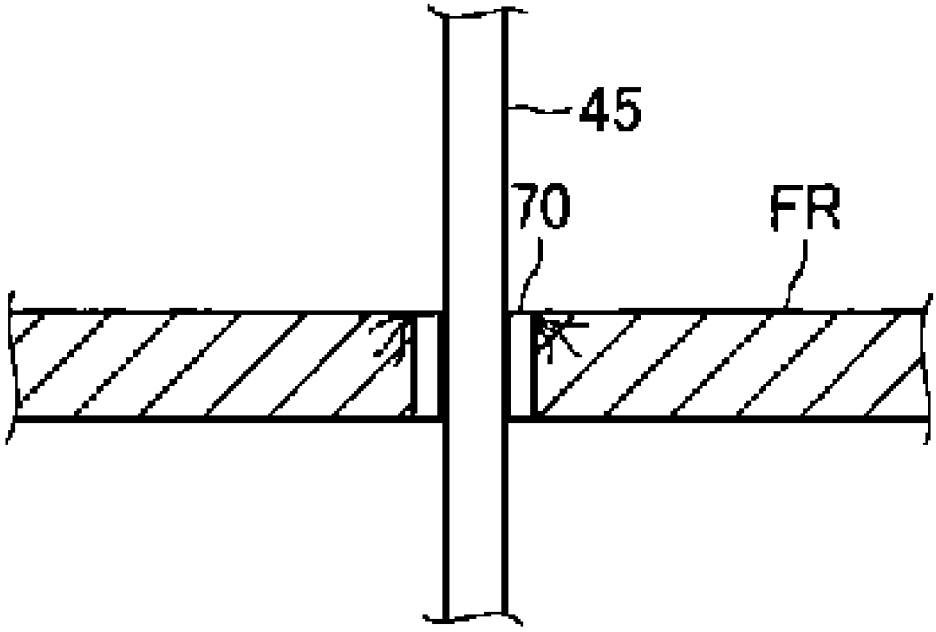
FIG. 11 is a diagram indicating a contact member which produces friction force on a drive rod according to modifications of the first and second embodiments.

The first and second embodiments are designed such that the first supporting portion 51*b* is in contact with the first pivoting member 52 to produce the friction force in the direction which restrains the pivoting of the first pivoting member 52. Instead of such a configuration or in addition to this configuration, as indicated in FIG. 11, the first and second embodiments may be modified to provide a contact member 70 which is in contact with the drive rod 45 to produce friction force in the direction which restrains upward and downward displacement of the drive rod 45.

In the first and second embodiments, the friction generating member 59 such as artificial leather or felt is fixed to the first supporting portion 51*b*. However, the first and second embodiments may be modified such that the friction generating member 59 is fixed to the first pivoting member 52. In the first and second embodiments, furthermore, the friction generating member 60 such as artificial leather or felt is fixed to the second pivoting member 53. However, the first and second embodiments may be modified such that the friction generating member 60 is fixed to the contact portion 51*f*.

In the first and second embodiments, the pedal apparatuses 12, 12A are applied to the damper pedal and the shift pedal of the electronic musical instrument. However, the pedal apparatuses 12, 12A can be also applied to a sostenuto pedal of an electronic musical instrument.

What is claimed is:

1. A pedal apparatus for an electronic musical instrument, the pedal apparatus comprising:

a lever supported for a pivotal movement to allow the lever to be pivotally moved upon depressing the lever;

a movable member displaceable from a first predetermined position to a second predetermined position, which is away from the first predetermined position toward a second direction upon depressing the lever, the movable member while at the first predetermined position being restricted from displacing toward first direction, which is opposite to the second direction;

a conveying member connected to the lever to cause displacement of the movable member from the first predetermined position toward the second predetermined position;

a first spring provided to urge the movable member toward the second direction upon depressing the lever;

a second spring provided to urge the movable member toward the first direction;

a first contact member in contact with the conveying member to produce a first friction force in a direction that restrains the displacement of the conveying member; and a second contact member in contact with the movable member to produce a second friction force in a direction that restrains the displacement of the movable member.

2. The pedal apparatus for use in an electronic musical instrument according to claim 1, wherein:

the displacement of the conveying member toward the first direction from the second predetermined position is restrictable by a fixed supporting member, while the conveying member is displaceable toward the second direction upon depressing the lever, and the second spring restricts the displacement of the movable member toward the second direction if the amount of depression of the lever is smaller than a predetermined amount, and allows the displacement of the movable member toward the second direction if the amount of depression of the lever is greater than or equal to the predetermined amount.

3. The pedal apparatus for an electronic musical instrument according to claim 2, wherein both ends of the first spring are in contact with the conveying member and the movable member respectively when the lever is not depressed.

4. The pedal apparatus for use in an electronic musical instrument according to claim 1, wherein the conveying member comprises:

a drive rod having a lower end in contact with the lever, the drive rod being displaceable in the first and second directions in accordance with the pivoting of the lever; and a pivoting member supported for a pivotal movement and being pivotal in accordance with the displacement of the drive rod.

5. The pedal apparatus for an electronic musical instrument according to claim 4, wherein the first contact member is in contact with the pivoting member to produce a first friction force in a direction which that restrains the pivoting of the pivoting member.

6. The pedal apparatus for an electronic musical instrument according to claim 4, wherein the first contact member is in contact with the drive rod to produce a first friction force in a direction that restrains the displacement of the drive rod.

7. The pedal apparatus for an electronic musical instrument according to claim 4, further comprising:

a capstan having a cylindrical head portion fixed on an upper surface of the pivoting member, the head portion opposing an undersurface of the movable member.

8. The pedal apparatus for an electronic musical instrument according to claim 4, further comprising:

a capstan having a cylindrical head portion fixed on an undersurface of the movable member, the head portion opposing an upper surface of the pivoting member.

9. The pedal apparatus for an electronic musical instrument according to claim 1, wherein the second friction force is greater than the first friction force.

10. The pedal apparatus for an electronic musical instrument according to claim 1, further comprising:

a third spring provided to exert a spring force on the lever at all times in a direction that resists the depression of the lever.

11. The pedal apparatus for an electronic musical instrument according to claim 10, wherein both ends of the first spring are in contact with the conveying member and the movable member respectively when the lever is not depressed.

12. The pedal apparatus for an electronic musical instrument according to claim 10, wherein one end of the first spring is spaced apart from the conveying member or the movable member when the lever is not depressed.

13. The pedal apparatus for an electronic musical instrument according to claim 1, further comprising:

an adjustment mechanism for adjusting magnitude of friction force to be produced on the movable member.

14. The pedal apparatus for an electronic musical instrument according to claim 1, further comprising:

a sensor for sensing an amount of displacement of the lever.

* * * * *